United States Patent [19]

Lough

[11] 4,291,479

[45] Sep. 29, 1981

[54] DAY-NIGHT SIGHT MOUNTING BRACKET FOR WEAPON

[75] Inventor: Lewis E. Lough, Springfield, Va.

[73] Assignee: The United States of America as represented by the Secretary of the Army, Washington, D.C.

[21] Appl. No.: 97,615

[22] Filed: Nov. 26, 1979

[51] Int. Cl.[3] ..... F41G 1/36

[52] U.S. Cl. ..... 42/1 A; 42/1 F

[58] Field of Search ..... 42/1 A, 1 S, 1 ST, 1 F; 33/233, 245, 250, 261; 362/110

[56] References Cited

U.S. PATENT DOCUMENTS

| | | | |
|---|---|---|---|
| 3,739,167 | 6/1973 | Avery | 42/1 A |
| 3,867,764 | 2/1975 | Dunmire et al. | 42/1 A |
| 4,079,534 | 3/1978 | Snyder | 42/1 A |
| 4,152,754 | 5/1979 | de Filippis et al. | 42/1 A |
| 4,161,076 | 7/1979 | Snyder | 42/1 A |

*Primary Examiner*—Charles T. Jordan

*Attorney, Agent, or Firm*—Nathan Edelberg; Milton W. Lee; Max L. Harwell

[57] ABSTRACT

The day-night sight mounting bracket has a day sight mounted to the weapon handle and specifically has flip out peep-sight and sighting-post on a pivot plate that is connected to a locking bracket that is wedged in the weapon handle. The pivot plate is pivotable on the locking bracket to provide any necessary elevation of the weapon when using the day sight. The locking bracket itself is mounted in the weapon handle by a three point-mounting arrangement that has front and rear pads in a weapon shoe portion of the locking bracket which fit against a foot portion of the weapon handle to form two of the three points. The locking bracket also has a tapered locking pin that fits snugly into a hole in the upper half of the weapon handle by turning a thumb screw that is threadably connected to the locking pin. The locking pin provides the third point of the three point-mounting.

The pivot plate further has a raised area with screw threadable hole therein for attaching an IR aiming light adapter bracket thereto by screw threadable means. The IR aiming light adapter bracket has an aiming light shoe at a forward end thereof upon which an IR aiming light is mounted. The IR aiming light adapter bracket and IR aiming light provides nighttime sighting for the normal daytime sighting of locking bracket and pivot plate.

3 Claims, 13 Drawing Figures

DAY-NIGHT SIGHT MOUNTING BRACKET FOR WEAPON

The invention described herein may be manufactured, used, and licensed by the U.S. Government for governmental purposes without the payment of any royalties thereon.

BACKGROUND OF THE INVENTION

1. Field of Invention

The present invention is in the field of a day-night sight mounting bracket that combines the da, sighting capability of a grenade launcher type weapon, such as a U.S. Army M203 grenade launcher, with a nighttime operation capability by adding an infrared (IR) aiming light adapter bracket and IR aiming light thereon to a pivot plate and locking bracket. The pivot plate has peep-and-post day and night sights thereon and is pivotable about the locking bracket such that an elevation-index plate that is on the locking bracket indicates the elevation indices of the day sight for targets at various ranges.

2. Description of the Prior Art

Previously, military weapons have either been equipped for daytime firing or for nighttime firing, with a conversion needed when switching from one to the other. An IR aiming light has been mounted on top of the weapon to provide an IR beam visible at nighttime along the bore of the weapon. With the IR aiming light on top of the weapon, the weapon operator had to move the hand not occupied with trigger operation, i.e. the hand that cradles or braces the weapon, up on top of the weapon to activate the IR aiming light. Since the IR aiming light beam is easily detectable by an enemy, it is quite important that the time which the IR aiming light is activated should be minimized.

SUMMARY OF THE INVENTION

The present day-night sight mounting bracket is comprised of an improved weapon mounted locking bracket and pivot plate in which the pivot plate is pivotably connected to the locking bracket for both daytime and nighttime sighting operations of a grenade launcher type weapon. For nighttime operation, an additional IR aiming light adapter bracket, with an IR aiming light attached thereto, may be quickly screw threadably attached to a raised area pivot plate foot on the outer portion of the pivot plate. The pivot plate further has flip-out sights for day sighting the weapon. The pivot plate is pivotable about a common pivot point on both the locking bracket and pivot plate to match the range of the target with an indicated range on a range-elevation index plate on the locking bracket for firing at a target at the indicated range. For nighttime operation, these flip-out sights may or may not be folded against the pivot plate. However, thse flip-out sights are preferably used in originally zeroing the IR aiming light beam with the boresight of the weapon.

The aiming light end of the IR aiming light adapter bracket is comprised of an IR aiming light shoe that is compatible with the foot portion of an IR aiming light wherein said IR aiming light is threadably attached thereto by an aiming light captivating lever screw assembly. The IR aiming light is zeroed in with the bore of the weapon. A dead man switch on the IR aiming light is conveniently positioned so that the weapon operator's weapon handle bracing hand may quickly activate the IR aiming light at any time without removing the bracing hand from the weapon handle. The adapter bracket has an angular offset forward and downward portion extending from the pivot plate end to the aiming light end.

The locking bracket has a three-point-mounting arrangement wherein there are front and rear pads in a locking bracket shoe in which the weapon handle foot fits therein to form two points of the three point-mounting arrangement. A tapered locking pin, which is adjusted by a thumb wheel to lock into a hole in the upper half of the weapon handle and wedge the locking bracket shoe against the weapon handle foot, forms the third point of the three pointmounting arrangement.

The day-night sight mounting bracket will be better understood in view of the detailed description hereinbelow in reference to the following drawings.

DETAILED DESCRIPTION OF THE PREFERRED EMBODIMENT

Figure 1:
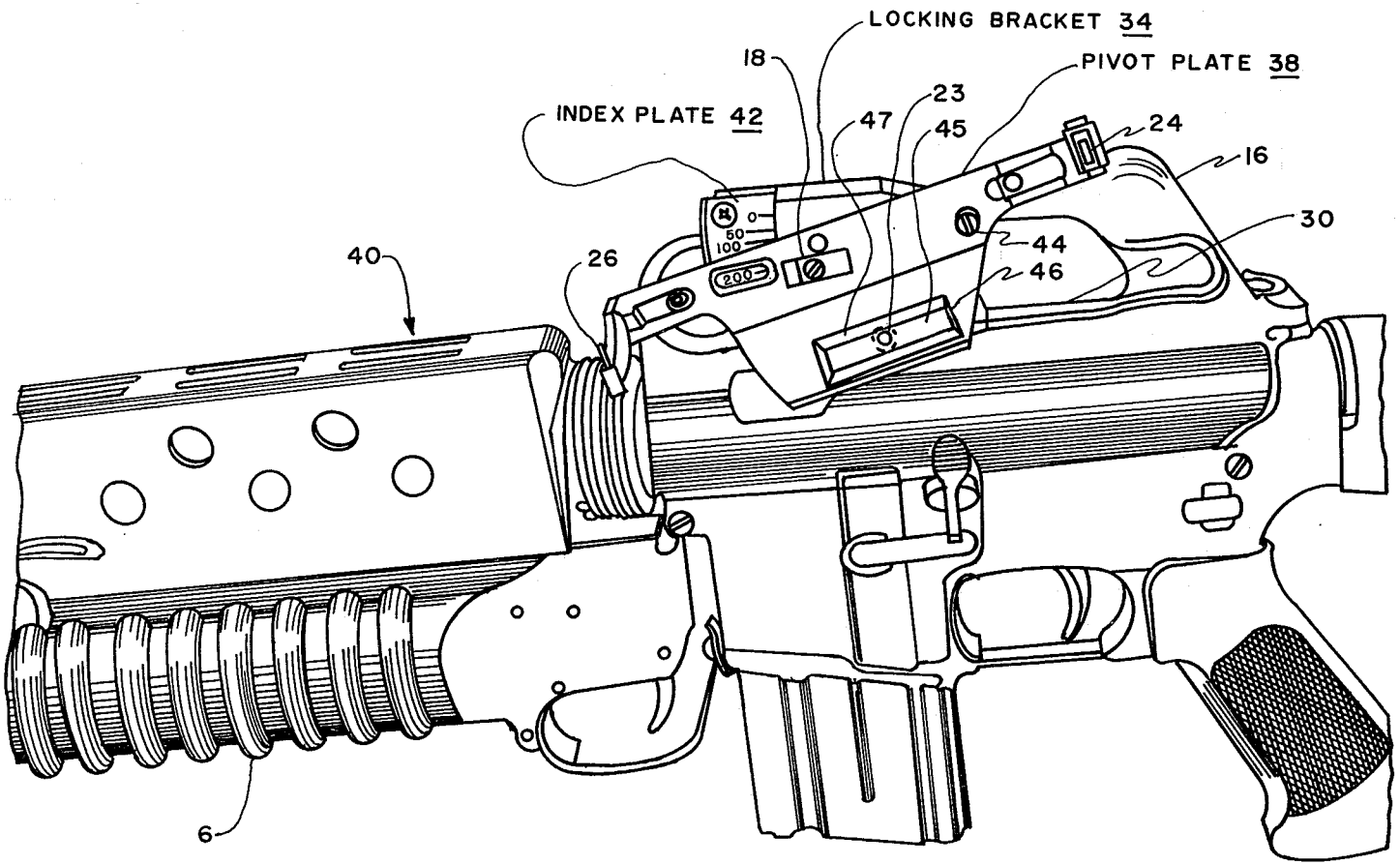
FIG. 1 illustrates the locking bracket and pivot plate day sight mounted on a weapon.
Figure 2:
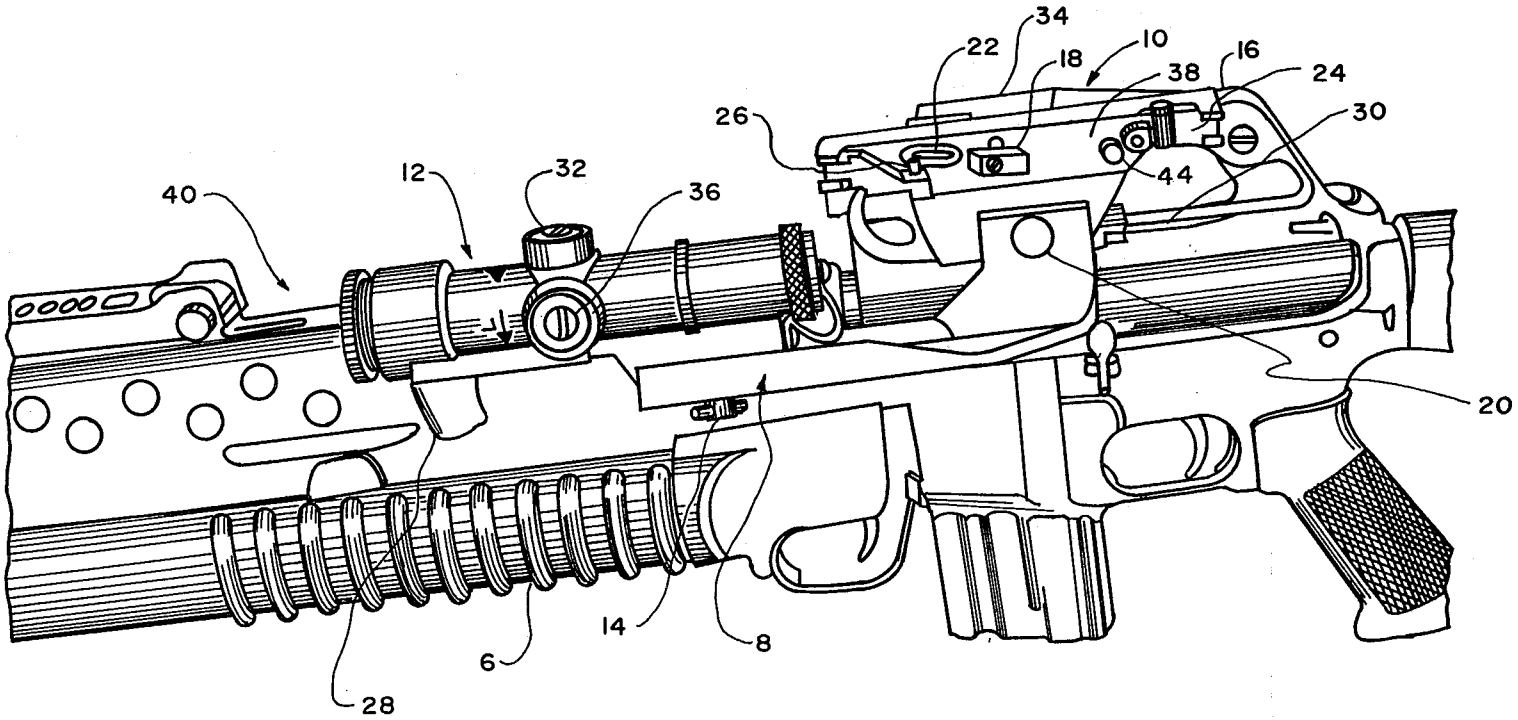
FIG. 2 illustrates the day-night sight mounting bracket with the IR aiming light attached to the IR aiming light adapter bracket.

Refer to FIGS. 1 and 2 where the present day-night sight mounting bracket is shown mounted on the breech part of a grenade launcher type weapon 40. In FIG. 1, only the daytime portion is shown, i.e. a locking bracket 34 having a locking bracket shoe and a tapered locking pin (neither of which are visible in either of FIGS. 1 or 2 but are shown in detail in FIGS. 10 through 13) which are compatibly fit into a weapon handle foot 30 and the upper half respectivley of weapon handle 16 with the pivot plate 38 having flip-out peep-hole and sighting-post sights 24 and 26 respectively thereon. FIG. 2 illustrates the same locking bracket 34 and pivot plate 38, which may be referred to herein as being combined into a sight bracket 10, with an infrared (IR) aiming light adapter bracket 8 having an IR aiming light 12 attached thereto, all threadably connected to the pivot plate 38. FIG. 2 illustrates an arrangement of the present day-night sight mounting bracket for a right handed weapon operator, i.e. the weapon operator using his right hand as a trigger hand and his left ahand for bracing the weapon stock 6. However, it should be noted that the mounting bracket may be operated by a left handed operator as well. One of the novel features of the present mounting bracket is that the dead man switch 28, which activates the IR aiming light 12, is conveniently placed by the weapon operator's bracing hand on the weapon stock 6 so that the bracing hand may selectively activate switch 28 while continuously bracing the weapon.

The locking bracket 34 has a three point-mounting arrangement in cooperation with weapon handle 16 to make bracket 34 highly stable with respect to the with weapon handle 16 to make bracket 34 highly stable with respect to the weapon. This three point-mounting arrangement is further discussed herein below and will only be mentioned at this point since other features of the locking bracket 34 and the relationship of the locking bracket to other components are expounded on herein below. The locking bracket 34 has an elevation-index plate 42 on the front portion thereof and a pivot point on the rear portion that is a common pivot point on the pivot plate 38, through which a pivot pin 44 passes.

Pivot plate 38 has an elevation-range sighting window 22 through which the numbers on the elevation-index plate 42 may be read. Under situations in which the range of the target is known, the spring loaded range positioning knob 18 may be slid away from locking grooves (not shown) in the elevation-index plate 42 which hold the pivot plate 38 to the locking bracket 34 and the pivot plate 38 pivoted to the indicated known elevation on plate 42 as shown at the index mark through window 22 and then knob 18 released to again lock the pivot plate 38 to the locking bracket 34. When the pivot plate 38 is locked to the locking bracket 34, the day-night sight mounting bracket is ready for daytime operation. However, the weapon may also be used for nighttime firing by connecting the IR aiming light adapter bracket 8 to pivot plate 38 by a captivating thumb screw 20 preferably having knurled outer edges and the IR aiming light 12 connected to the adapter bracket 8 by a captivating lever screw assembly 14.

Figure 4:
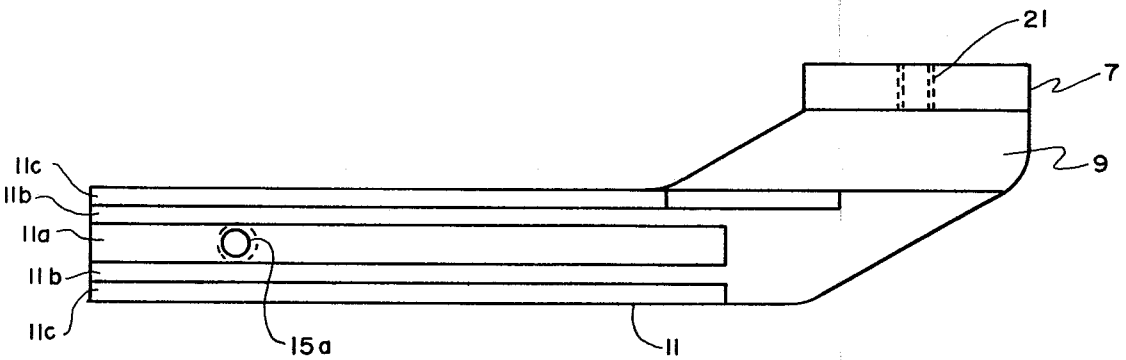
FIG. 4 ilustrates a top view of th IR aiming light adapter bracket.
Figure 5:
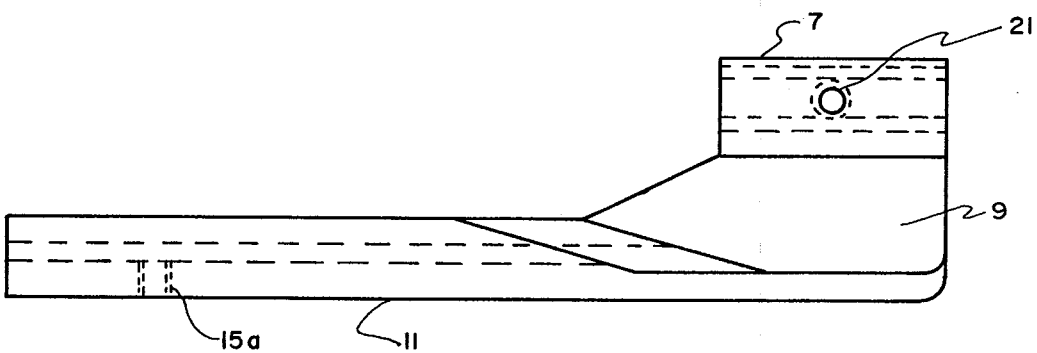
FIG. 5 illustrates a side view looking toward the weapon of the IR aiming light adapter bracket.
Figure 3:
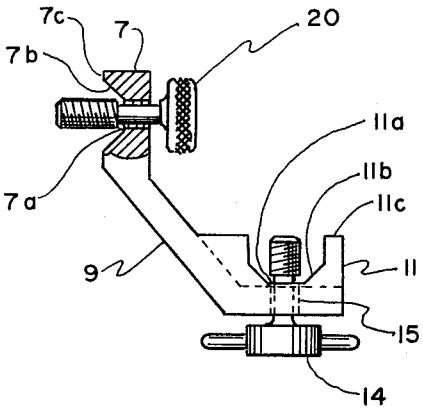
FIG. 3 shows a frontal view of the IR aiming light adapter bracket.

Refer now to FIGS. 3, 4, and 5 which show the adapter bracket 8. The adapter bracket 8 may be held firmly to the pivot plate 38 by a pivot plate shoe at a pivot plate end 7 of bracket 8 that is compatibly fit onto the raised area pivot plate foot 46 by the pivot pin 20 passing through a threaded pivot pin hole 21 of bracket 8 and screw threadably connected to the threaded captivating thumb screw hole 23 in the raised area pivot plate foot 46. The captivating lever screw assembly 14 that attaches the IR aiming light 12 to the IR aiming light adapter bracket 8 is preferably a winged lever screw having a screw 15 attached thereto that is screw threaded through a lever screw hole 15*a* and into the foot of the IR aiming light 12. The narrow IR light beam emitted from IR aiming light 12 may be zeroed with the bore of the weapon by flipping out the rear peep-hole sight arm 24 and front sighting-post arm 26 having respectively a peep-hole and sight post thereon when the pivot plate 38 is set for no elevation and by adjustment of the IR aiming light beam elevation adjustment means 32 and azimuth adjustment means 36 setting the IR beam on the same target as viewed through the day sight.

Figure 6:
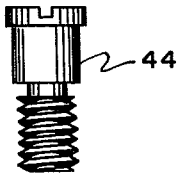
FIG. 6 shows a typical pivot pin that is connected through said pivot plate screw threaded into said locking bracket.
Figure 12:
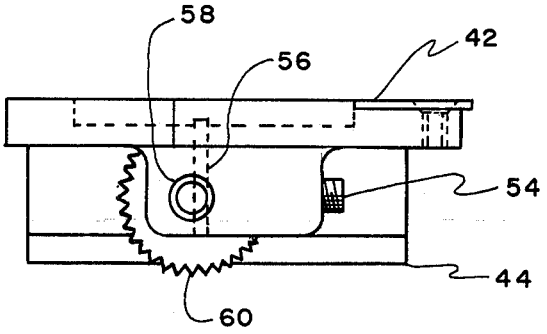
FIG. 12 illustrates a top view of the locking bracket.
Figure 10:
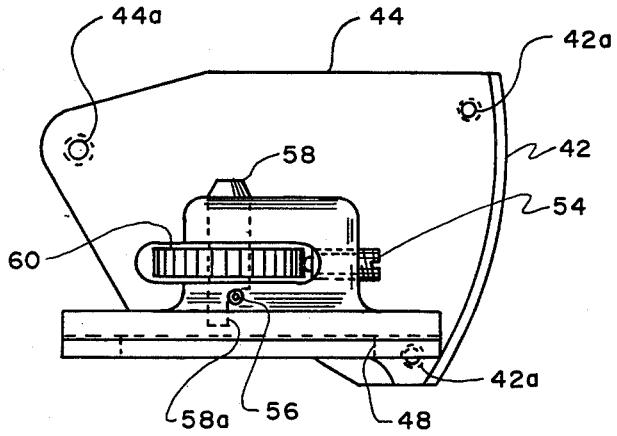
FIG. 10 illustrates a side view of the locking bracket looking away from the weapon.
Figure 13:
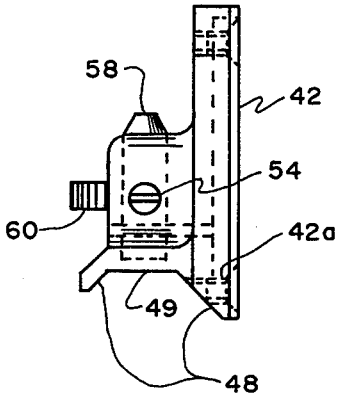
FIG. 13 shows a frontal view of the locking bracket.
Figure 11:
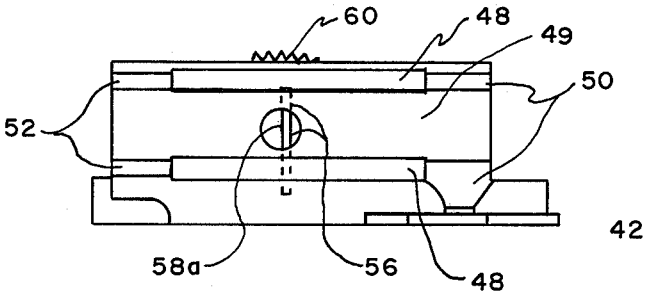
FIG. 11 shows a bottom view of the locking bracket.

Look now at FIGS. 10, 11, 12, and 13 for an explanation of the present locking bracket 34. FIG. 10 illustrates a side view of locking bracket 34 which is the side that would be closest to the weapon handle 16. FIGS. 11 and 12 are respectively bottom and top views of the locking bracket 34 and FIG. 13 is a frontal view of bracket 34. Numeral 50 indicates beveled front pads of the locking bracket weapon shoe. Numeral 52 indicates beveled rear pads of the locking bracket weapon shoe. Numeral 48 shows beveled side relief areas between the front and rear pads 50 and 52. Numeral 49 indicates a flat base relief area running the entire length of the locking bracket weapon shoe. Front pads 50 and rear pads 52, with one on each side of the flat relief area 49, form two points of the three point-mounting arrangement for locking bracket 34 when they are pressed against the weapon handle foot 30. The third point, which is the tapered locking pin 58, provides wedging action of the locking bracket between pin 58 in a hole in the upper half of weapon handle 16 and pads 50 and 52 against the weapon handle foot 30. Tapered locking pin 58 is extended out into the hole in the weapon handle 16 by turning of thumb wheel 60 that is threadably connected to pin 58. The end of the tapered locking pin 58 that is opposite the end that fits in the weapon handle arm has a cut-out portion that forms a flat face area 58*a*. The flat face area 58*a* is kept from turning by a spring pin 56 that is press fit through the mounting bracket adjacent to the flat face area 58*a*. When the tapered locking pin 58 is threaded by thumb wheel 60 to fit tightly in the hole in the upper half of the weapon handle 16, pin 58 wedges the front and rear pads of the locking bracket weapon shoe 50 and 52 against the weapon handle foot 30. A threadable retaining means 54 is positioned against the knurled outer edge of thumb wheel 60 to keep the thumb wheel from vibrating loose. p FIGS. 10, 12, and 13 also show the relative positions of pivot pin threaded hole 44*a* into which the pivot pin 44 is threaded, the elevation-index plate 42, and two elevation-index plate screw threadable holes 42*a* into which plate 42 is threadably attached. FIG. 6 illustrates the pivot pin 44 in which the larger smooth portion of the stem fits snugly into the smooth bore pivot pin hole 43 in the pivot plate and the smaller threaded portion of the stem is screw threadably connected to pivot pin threaded hole 44*a* of the locking bracket 34.

Figure 9:
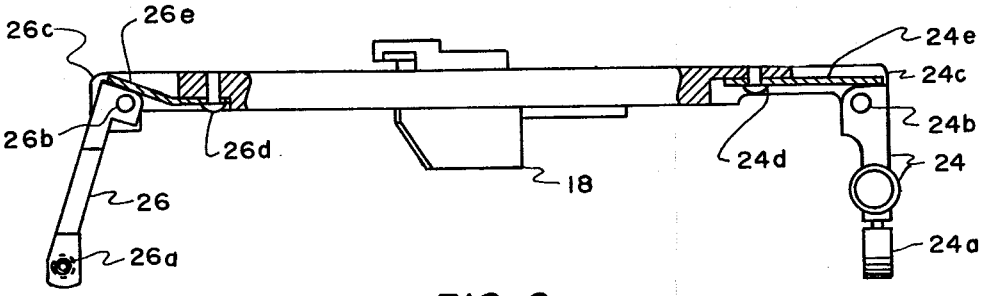
FIG. 9 illustrates a top view of the pivot plate.
Figure 7:
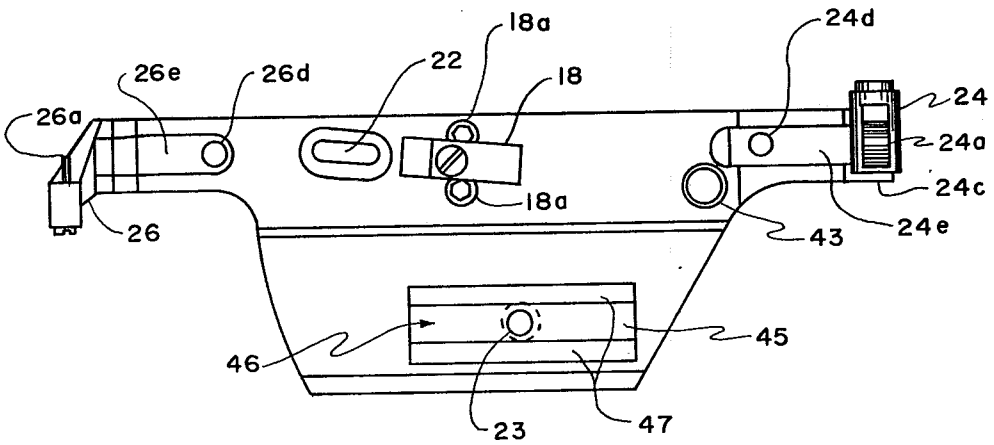
FIG. 7 illustrates a side view looking toward the weapon of the pivot plate.
Figure 8:
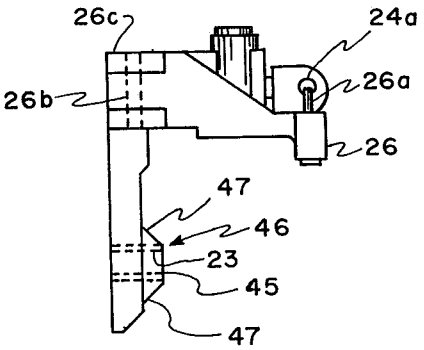
FIG. 8 shows a frontal view of the pivot plate.

Refer now to FIGS. 7, 8, and 9 for a better explanation of the pivot plate 38. FIG. 7 shows a side view of the pivot plate looking toward the weapon with the flip-out sights present. The raised area pivot plate foot 46 is shown with the flat outer face 45 having the threaded captivating thumb screw hole 23 therein and the two beveled edges 47 on each side of outer face 45. Numerals 18*a* represent brads or rivets which hold the range positioning knob 18 base firm while the range positioning knob 18 may slide back and forth as needed. Pivot pin hole 43 and elevation-range sighting window 22 are located as shown. Look now also to FIG. 9 which has the peep-hole sight arm 24 and sighting-post arm 26 thereon. Numeral 24*a* represents the peep-hole. Numeral 24*b* represents the retainer pin for the peep-hole sight arm, with numeral 24*c* representing the peep-hole sight arm support through which pin 24*b* is set. Numerals 24*d* and 24*e* represents the peep-hole sight arm leaf spring rivet and the leaf spring respectively that lock arm 24 steadily in the flipped in or flipped out positions. Numeral 26*a* represents the sight post on the sighting-post arm 26. Numerals 26*b*, 26*c*, 26*d*, and 26*e* represent like parts and functions as in the peep-hole sight arm 24 reference numbers, i.e. numerals 26*b* and 26*c* respectively represent the retainer pin for the sighting-post arm 26 and the support through pin 26*d* and 26*e* respectively represent the sighting-post leaf spring rivet and the leaf spring that hold the sighting-post arm 26 steadily either in the flipped in or flipped out position.

Refer now to FIGS. 3, 4, and 5 for an explanation of the IR aiming light adapter bracket 8. Bracket 8 is comprised of pivot plate end 7, aiming light end 11, and an angular offset portion 9 therebetween. Pivot plate end 7 has a pivot plate shoe that is compatible with the raised area pivot plate foot 46 of pivot plate 38. Captivating thumb screw 20 has a smooth stem portion that passes through the flat base portion 7*a* of the pivot plate shoe and a threaded stem portion that threadably connects to the threaded captivating thumb screw hole 23 in the raised area pivot plate foot 46. Beveled sides 7*b* of the pivot plate shoe fits against the beveled edges 47 of the embossed area. The aiming light end 11 has an IR aiming light shoe that is compatible with the foot of an IR aiming light 12. A captivating lever screw assembly 14 having a lever screw stem that is threaded through the flat base portion 11*a* of the aiming light shoe and threaded into the foot of the aiming light. Beveled sides 11*b* are compatibly fit against the IR aiming light foot. The angular offset portion 9 extends forward and downward from the pivot plate end 7 of the aiming light end 11 so that the dead man switch 28 on the IR aiming light 12 is conveniently positioned in proximity to the weapon operator's brace hand. FIGS. 4 and 5 additionally show the threaded lever screw hole 15*a* for the lever screw stem 15 to thread through and the threaded captivating thumb screw hole 21.

I claim:

1. A day-night sight mounting bracket for a grenade launcher type weapon in which said weapon may be used for both daytime operation and nighttime operation wherein an infrared aiming light used for nighttime operation is positioned so that weapon operator may selectively activate said infrared aiming light while continuously bracing the weapon handle, said day-night sight mounting bracket comprising:

a locking bracket that is compatibly fit and rigidly mounted into the weapon handle of said weapon in a three point-mounting arrangement and having an elevation-range index plate mounted on the front portion thereof and a pivot point threaded hole in the rear portion thereof wherein said locking bracket is comprised of a locking bracket shoe having a front pad and a rear pad with a relief area therebetween which is fit into a foot of said weapon handle and a tapered thumb screw locking pin that is screw threadably connected to a thumb wheel to extend and lock said tapered thumb screw locking pin firmly into a hole in the upper half of the weapon handle in which the tapered portion of said tapered thumb screw locking pin forms one point of said three point-mounting arrangement and wedges the mounting bracket firmly against the weapon handle of said front and rear pads wherein said front and rear pads form the other two points of said three point-mounting arrangement;

a pivot plate pivotably connected at a common pivot point with the pivot point threaded hole in said locking bracket wherein said pivot plate is comprised of flip-out peep-hole and sighting-post day-night sights and an open sighting window on the front section thereof for directly viewing selected elevation and ranges from said elevation-range index plate on said locking bracket as said pivot plate is pivoted about said locking bracket and a smooth bore pivot pin hole in the rear portion thereof and an outer raised area pivot plate foot with a threaded screw hole therein; and an infrared aiming light adapter bracket comprised of a pivot plate end of said adapter bracket having a pivot plate shoe with a threaded hole through the base thereof in which said pivot plate shoe is compatible with the outer raised area pivot plate foot wherein a captivating thumb screw having a smooth stem within said pivot plate shoe and threads on the end of said stem that are threadably connected within said threaded screw hole in said raised area pivot plate foot and an aiming light end of said infrared aiming light adapter bracket having an aiming light shoe that is compatible with an infrared aiming light foot mounted thereon wherein a captivating lever screw assembly screw threadably connects said infrared aiming light foot into said infrared aiming light shoe of said adapter bracket and an angular offset forward and downward portion of said infrared aiming light adapter bracket extends from said pivot plate end to said aiming light end wherein a dead man switch on said infrared aiming light is in the proximity to the weapon handle bracing hand of the weapon operator so that the thumb of the bracing hand may selectively activate said infrared aiming light by use of said thumb against said dead man switch while continuously bracing said weapon at said weapon handle.

2. A mounting bracket as set forth in claim 1 wherein both of said front pad and rear pad in the locking bracket shoe are comprised of raised portions on beveled sides and on a central flat area between said raised portion beveled sides with said relief areas formed on the remainder of said beveled sides and central flat area between the raised portion beveled sides and raised portion central flat area.

3. A mounting bracket as set forth in claim 2 wherein said pivot plate is pivotably connected at said common pivot point with said locking bracket by a pivot pin that is connected through said smooth bore pivot pin hole in said pivot plate and is screw threadably connected to said pivot point threaded hole in said locking bracket.

* * * * *